United States Patent [19]

Vessey et al.

[11] 4,267,933

[45] May 19, 1981

[54] LOGGING CARRIAGE

[76] Inventors: Rodney W. Vessey, 1016 W. 13th Ave., Meridian, Id. 83642; Colin C. Rhoades, Box 34, White Bird, Id. 83554

[21] Appl. No.: 928,079

[22] Filed: Jul. 26, 1978

[51] Int. Cl.[3] ..... B66C 21/00

[52] U.S. Cl. ..... 212/108; 104/112; 104/173 R; 212/92; 212/122; 254/391

[58] Field of Search ..... 212/71–123; 104/93, 112, 113, 173 R, 183, 238, 239; 254/147, 139.1, 166, 280, 325, 327, 391

[56] References Cited

U.S. PATENT DOCUMENTS

| | | | |
|---|---|---|---|
| 114,496 | 5/1871 | Van Demark | 212/108 |
| 128,537 | 7/1872 | Chapman | 212/109 X |
| 517,859 | 4/1894 | Hewett | 212/92 |
| 806,829 | 12/1905 | Olson | 212/108 |
| 901,318 | 10/1908 | Browning | 212/108 |
| 1,360,475 | 11/1920 | Venable | 212/122 X |
| 2,593,881 | 4/1952 | Henderson | 212/100 |
| 2,649,209 | 8/1953 | Wilson | 212/122 X |
| 3,844,419 | 10/1974 | Holmes | 212/122 |

*Primary Examiner*—Stephen G. Kunin
*Assistant Examiner*—Edmond G. Rishell, Jr.
*Attorney, Agent, or Firm*—Harvey B. Jacobson

[57] ABSTRACT

A carriage is provided for guided movement along a skyline and includes guide structure for supporting a dragline for longitudinal shifting relative to the carriage. A skyline stop is provided for coaction with the carriage, a dragline abutment is provided for coaction with the carriage and the carriage includes a stop with which the abutment is engageable to limit movement of the dragline in one direction relative to the carriage. The carriage is engageable with the skyline stop to limit movement of the carriage downwardly along the skyline and the abutment is provided for engagement with the carriage stop to limit upward movement of the dragline relative to the carriage. Latch structure is shiftably supported from the carriage for movement between first and second positions and is latchingly engageable with the skyline stop and engageable with the dragline abutment when in one position and inoperative to latchingly engage the skyline stop and engage the dragline abutment when in the second position. However, the latch structure and skyline stop and dragline abutment include coacting portions for shifting the latch toward the second position thereof in response to movement of the carriage down the associated skyline to the lower limit position thereof defined by the skyline stop and movement of the dragline upwardly relative to the carriage to a position closely spaced from the upper limit position thereof defined by engagement of the abutment with the carriage stop.

5 Claims, 9 Drawing Figures

LOGGING CARRIAGE

BACKGROUND OF THE INVENTION

Various forms of skyline log skidding carriages have been heretofore provided. While some of these previous carriages have been provided with automatic locks for releasably locking the carriage in the desired lowermost position thereof along the associated skyline, most lock equipped carriages are subject to mechanical failures and/or are extremely heavy, complicated and expensive. Accordingly, a need exists for an automatically locking logging carriage of light weight simple construction whereby its efficient operation without breakdown and requiring frequent maintenance will be assured and the expense thereof may be maintained at a minimum.

Examples of previously known logging carriages including some of the general structural and operational features of the instant invention are disclosed in U.S. Pat. Nos. 982,737, 1,543,473, 1,725,325, 2,649,209, 2,790,561, 3,844,419 and 3,948,398.

BRIEF DESCRIPTION OF THE INVENTION

The carriage of the instant invention includes only one primary moving part operative in conjunction with a skyline stop and a dragline abutment. Further, the one primary moving part of the carriage comprises a simple first class lever and the only other additional structure required by the carriage comprises structure for yieldingly biasing the lever toward one limit position of movement thereof.

The main object of this invention is to provide an automatically locking skyline supported logging carriage.

Another object of this invention is to provide a carriage incorporating a simple locking or latching mechanism and constructed in a manner whereby the locking mechanism may be shifted from the locked position thereof to the unlocked position thereof by engagement of a single shiftable component with either a skyline stop or a dragline abutment.

Yet another important object of this invention is to provide a skyline carriage of light weight construction.

Another important object of this invention is to provide a carriage utilizing the simpliest possible form of actuating mechanism.

A final object of this invention to be specifically enumerated herein is to provide a logging carriage in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
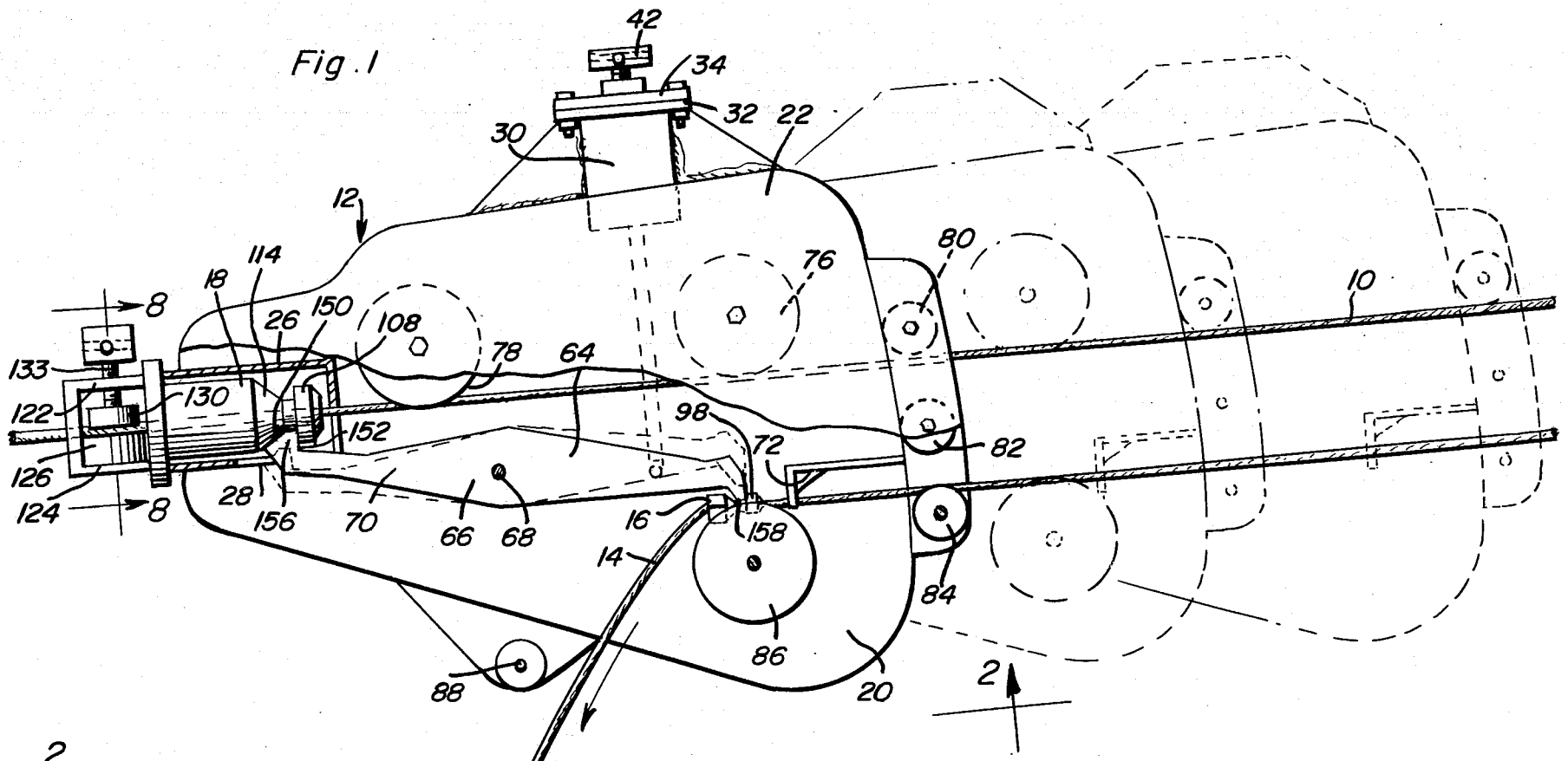
FIG. 1 is a side elevational view of the carriage of the instant invention in operative association with a skyline, a dragline, a stop mounted on the skyline and an abutment mounted on the dragline, portions of the carriage being broken away and illustrated in vertical section and alternate positions thereof on the skyline being illustrated in phantom lines.
Figure 2:
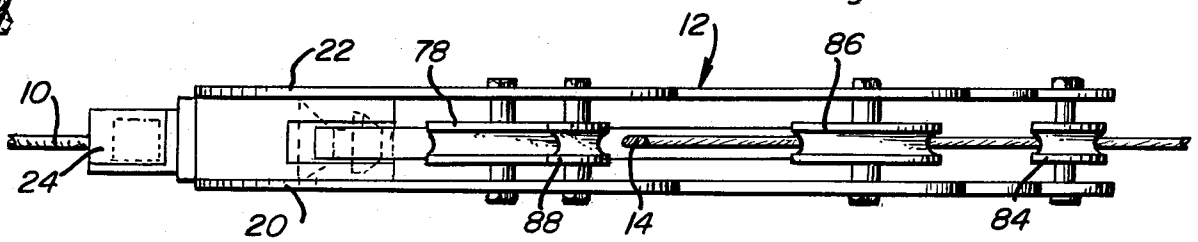
FIG. 2 is a bottom plan view of the carriage as seen from the section line 2—2 of FIG. 1.

Referring now more specifically to the drawings, the numeral 10 designates a taught skyline, the numeral 12 generally designates a carriage constructed in accordance with the present invention, the numeral 14 designates a dragline upon which an abutment 16 is mounted and the reference numeral 18 designates a stop mounted on the skyline 10.

The carriage 12 includes a pair of opposite side plates 20 and 22 interconnected along the upper marginal edge portions by means of a top plate 24 extending and secured therebetween and the rear portion of the carriage 12 defines a rearwardly opening housing or socket 26 in which the stop 18 is receivable. The socket 26 comprises a hollow rearwardly opening housing secured between the side plates 20 and 22, the socket 26 having a downwardly opening slot 28 formed in its lower forward portion.

The top plate 24 has the lower portion of a support sleeve 30 secured therethrough and the support sleeve 30 is closed at its upper end by means of a centrally apertured closure plate 32 secured thereover. In addition, a crown plate 34 is secured over the closure plate 32 and has a central boss 36 mounted on its upper surface, the central boss 36 and crown plate 34 having a threaded bore 38 formed therethrough. An adjusting screw 40 is threadedly secured through the bore 38 and includes an enlarged upper end head 42. The lower end of the adjusting screw 40 bears against the upper side of a slide block 44 slidable in the support sleeve 30 and the upper end of a compression spring 46 bears against the underside of the slide block 44. The lower end of the compression spring 46 bears against the upper surface of a follower 48 projecting upwardly from a downwardly opening bifurcated yoke 50 and the upper end of the follower 48 is guidingly telescopingly received in the open lower end of the support sleeve 30. The depending legs 52 and 54 of the yoke 50 embracingly receive the skyline 10 between their upper ends and include lower end inturned portions 56 and 58 rotatably received in opposite side outwardly opening sockets 60 and 62 formed in one forward end portion 64 of a first class lever 66 pivotally supported between the plates 20 and 22 as at 68 and including a second rear end portion 70 disposed on the side of the pivot 68 remote from the end portion 64. The lever 66 extends longitudinally of the carriage 12 and the rear end portions 70 of the lever 66 is projectible upwardly through the slot 28 for engagement with the stop 18 when the latter is seated in the socket 26. In addition, the forward end portion 64 of the lever 66 is engageable with the abutment 16 when the latter is approaching or has reached its forward limit of movement relative to the carriage 12 as defined by a carriage stop 72 supported between the plates 20 and 22 and with which the abutment 16 is engageable to limit forward movement of the dragline 14 relative to the carriage 12.

The carriage 12 journals a pair of front and rear main support pulleys 76 and 78 between the upper portions of the side plates 20 and 22. The pulleys 76 and 78 engage the skyline 10 and support the carriage 12 from the skyline 10 for movement therealong above the stop 18. In addition, the forward end of the carriage includes vertically spaced guide pulleys 80, 82 and 84. The guide pulley 80 also rollingly engages the skyline 10 and the pulley 82 is disposed between the skyline 10 and the dragline 14 for guiding action on the latter in the event the upper end of the carriage 12 should shift upwardly or downwardly, respectively, relative to the skyline and dragline. The pulley 84 underlies the dragline 14 and the carriage 12 includes a third support pulley 86 journaled between the lower portions of the side plates 20 and 22 over which the dragline 14 is guidingly engaged. Further, the lower marginal portions of the side plates 20 and 22 journal a guide roller 88 therebetween for guiding action on the upper side of the lower end of the dragline 14 depending downwardly from the carriage 12.

Figures 3, 4, 5, 6:
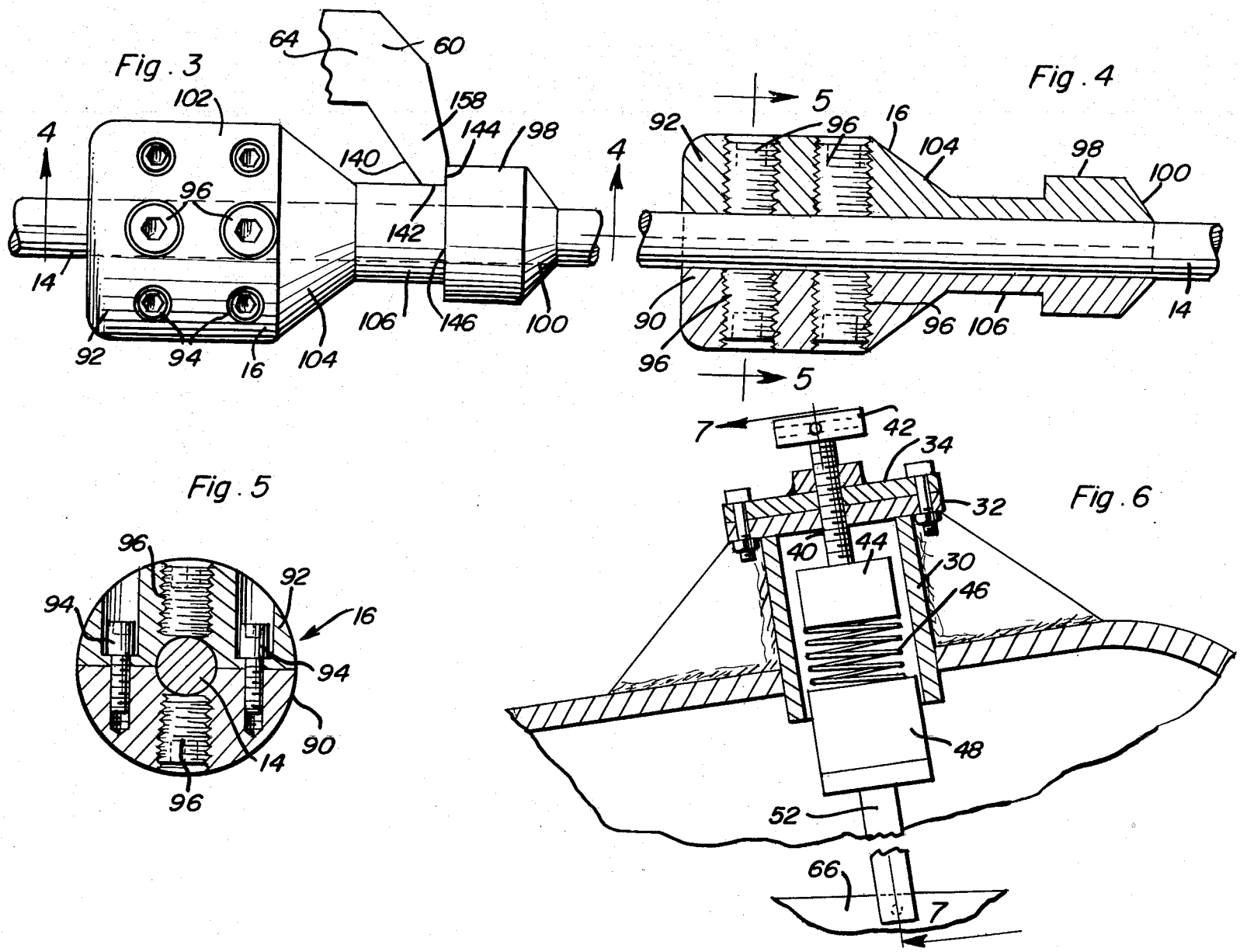
FIG. 3 is an enlarged, fragmentary, elevational view illustrating the operative association of the dragline abutment and latch lever of the carriage.
FIG. 4 is a fragmentary, sectional view taken substantially upon the plane indicated by the section line 4—4 of FIG. 2.
FIG. 5 is a transverse, sectional view taken substantially upon the plane indicated by the section line 5—5 of FIG. 4.
FIG. 6 is a fragmentary, vertical, sectional view illustrating the structure by which the latching lever is biased toward a first limit position of movement thereof.
Figure 8:
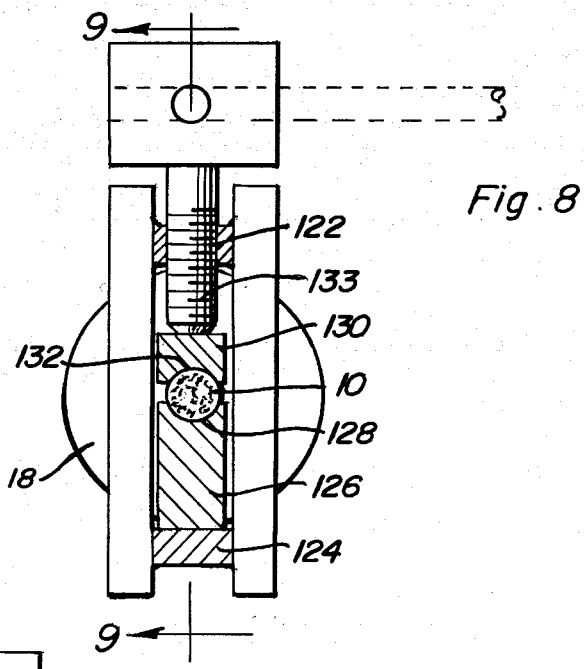
FIG. 8 is an enlarged, fragmentary, vertical, sectional view taken substantially upon the plane indicated by the section line 8—8 of FIG. 1.

With attention now invited more specifically to FIGS. 3, 4 and 5 of the drawings, it will be seen that the abutment 16 comprises a pair of abutment halves 90 and 92 secured together in clamped relation about the dragline 14 by means of threaded fasteners 94. In addition, the halves 90 and 92 each include longitudinally spaced set screws 96 in tight frictional engagement with the dragline 14. The forward end of the abutment 16 defines a small diameter forward end portion 98 thereof including a forwardly facing conical surface 100 and the rear end portion of the abutment 16 defines a rearward larger diameter portion 102 thereof including a forwardly facing conical surface 104. A central cylindrical portion 106 extends between the forward extremity of the rear conical surface 104 and the smaller diameter cylindrical portion 98.

Figure 9:
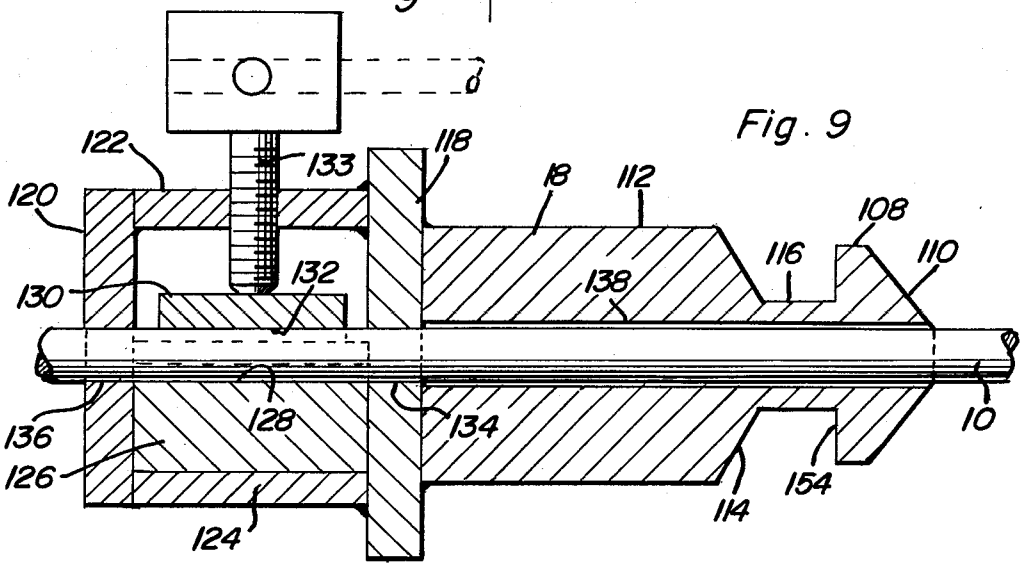
FIG. 9 is a vertical, sectional view taken substantially upon the plane indicated by the section line 9—9 of FIG. 8.
Figure 7:
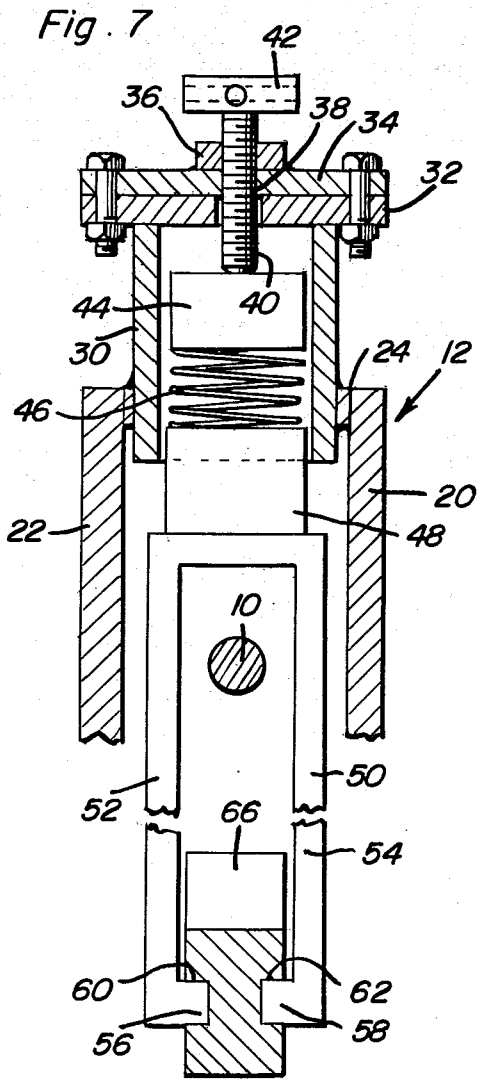
FIG. 7 is an enlarged, fragmentary, vertical, sectional view taken substantially upon the plane indicated by the section line 7—7 of FIG. 6.

The stop 18 also includes a small diameter portion 108, FIG. 9 corresponding to the portion 98, FIG. 3 and including a forward conical surface 110, a rear larger diameter portion 112 corresponding to the portion 102 and including a forward conical surface 114 corresponding to the surface 104 and a cylindrical central portion 116 corresponding to the portion 106. However, the stop 18 is of one-piece construction and is welded to and projects forwardly of the front side of a centrally apertured plate 118 rearwardly of which a second centrally apertured rear plate 120 is supported by means of upper and lower bracing plates 122 and 124 extending and secured between corresponding upper and lower marginal portions of the plates 118 and 120. A lower abutment plate 126 is supported from the upper surface of the plate 124 and extends between the confronting sides of the plates 118 and 120. The abutment plate 126 includes an upwardly opening generally semi-cylindrical groove 128 formed therein and an upper abutment plate 130 extending lengthwise between the plates 118 and 120 and including a generally semi-cylindrical downwardly opening groove 132 is provided and abutted, centrally intermediate its opposite ends, by the lower end of an adjusting screw 133 threaded downwardly through the plate 122. The groove 128 is substantially coextensive with the lower portions of the central apertures 134 and 136 formed through the plates 118 and 120 and the stop 18 has a central bore 138 extending longitudinally therethrough coaxial with the apertures 134 and 136. The skyline 10 extends through the bore 138, the apertures 134 and 136 and is clamped between the abutment plates 126 and 130. Of course, the clamping action of the plates 126 and 130 on the skyline 10 fixes the position of the stop 18 on the skyline 10.

With attention now invited more specifically to FIG. 3 of the drawings, it may be seen that the end portion 64 of the lever 60 includes a cam surface 140 engageable with the conical surface 100 and the conical surface 104. In addition, the end portion 64 includes a surface 142 abuttingly engaged with the central cylindrical portion 106 and a surface 144 engageable with the shoulder 146 defined by the portion 98 at the forward extremity of the central cylindrical portion 106. Also, the rear end portion 70, FIG. 1 of the lever 68 includes a cam surface 150 engageable with the conical surfaces 110 and 114 and an abutment surface 152 engageable with the shoulder 154 defined by the portion 108 at the forward extremity of the central cylindrical portion 116 of the stop 18.

In operation, as the dragline 14 is backed down with the surface 144 engaged with the shoulder 146, the carriage 12 is allowed to move downwardly along skyline 10 and downward movement of the dragline 14 relative to the carriage 12 is prevented. However, as the carriage 12 approaches the lower limit position thereof defined by seated engagement of the stop 18 in the socket or housing 26 and the lower end of carriage 12 with plate 118, the cam surface 150 on the end portion 70 of the lever 66 engages the surface 110 and causes the lever 66 to pivot from the limit position thereof illustrated in solid lines in FIG. 1 and to which the lever 66 is yieldingly biased by means of the compression spring 46 toward the second phantom line position thereof illustrated in FIG. 1. However, as the terminal end 156 of the lever 66 on which the surfaces 150 and 152 are formed rides over the portion 108, the end portion 64 of the lever 66 is not elevated sufficiently in order to be elevated above the portion 98. After the terminal end 156 moves behind the portion 108, it engages the portion 116. Thereafter, as the surface 150 engages the surface 114, the terminal end 156 is depressed downwardly by the surface 114 to the extent that the terminal end 158 of the end portion 64 is elevated above the portion 98 thereby allowing the abutment 16 to move rearwardly of the terminal end 158 and the dragline 14 to be lowered relative to the carriage 12. However the abutment 16 is not released from the lever 66 until after the terminal end 156 is displaced behind shoulder or stop latch surface 154, thereby assuring that carriage 12 may not move to the right as viewed in FIG. 1 after dragline 14 has been released. After the dragline 14 has been sufficiently lowered, the chokers (not shown) supported from the lower end portion of the dragline 14 are engaged with the log or logs to be elevated by the carriage 12. Thereafter, the dragline 14 is elevated until the abutment 16 approaches the terminal end 158 of the end portion 64 of the lever 66. The surface 140 is engaged by the surface 100 and the portion 98 passes beneath terminal end 158. Thereafter, the surface 140 engages the surface 104 and the end portion 64 is elevated by the surface 104 sufficiently to depress the terminal end 56 below the portion 108 whereby the carriage 12 will be released from the stop 18 and move slightly upwardly along the skyline 10 (due to the weight supported from the dragline 14) until the terminal end 158 of the end portion 64 of the lever 66 again engages the shoulder 146. Thereafter, upward pull on the dragline 14 causes the carriage 12 to move upwardly along the skyline 10, the stop 72 limiting upward movement of the abutment 16 relative to the carriage 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an inclined skyline, a carriage guidingly supported from said skyline for movement therealong, a stop carried by said skyline for limiting downward movement of said carriage along said skyline, said carriage including guide means, a dragline guidingly supported from said guide means for longitudinal shifting relative to said carriage and including one end portion extending upwardly along said skyline and a lower end portion depending downwardly from said skyline, an abutment carried by said dragline abuttingly engageable with said carriage for limiting upward movement of said dragline relative to said carriage, latch means shiftably supported from said carriage for movement between a release position and a latch position relative to said carriage, means yieldingly biasing said latch means toward said latch position, said stop including a latch surface engageable by said latch means, upon downward approach of said carriage along said skyline to a first latching position closely adjacent the lower limit position of movement of said carriage on said skyline defined by said stop, to latch said carriage against upward movement along said skyline, said abutment including a latch surface engageable by said latch means, upon upward approach of said dragline relative to said carriage toward a second latching position closely adjacent the upper limit position of movement of said dragline relative to said carriage, to prevent downward movement of said dragline relative to said carriage, said stop including a cam surface, on the side of said stop latch surface remote from the upper end of said skyline, engageable by said latch means to cam said latch means from said latch position toward said release position upon downward movement of said carriage along said skyline past said first latching position, and said abutment including a cam surface on the side of said abutment latch surface remote from said one upper end portion of said dragline operative to cam said latch means toward said release position upon upward movement of said dragline relative to said carriage past said second latching position.

2. The combination of claim 1 wherein said skyline stop includes means guidingly engaging said skyline for shifting therealong and releasable lock means releasably locking said stop in adjusted position on said skyline.

3. The combination of claim 1 wherein said abutment includes means guidingly engaging said dragline for shifting therealong and means for releaseably locking said abutment relative to said skyline against shifting relative thereto.

4. The combination of claim 1 wherein said latch means comprises, only, a single lever oscillatably supported from said carriage.

5. The combination of claim 4 wherein said lever comprises a first class lever.

* * * * *